US008056159B2

(12) United States Patent
Lee et al.

(10) Patent No.: US 8,056,159 B2
(45) Date of Patent: Nov. 15, 2011

(54) MATTRESS SUPPORTING SYSTEM

(75) Inventors: Youn Jae Lee, Pleasanton, CA (US); Suk Kan Oh, Xiamen (CN)

(73) Assignee: Zinus, Inc., Hayward, CA (US)

( * ) Notice: Subject to any disclaimer, the term of this patent is extended or adjusted under 35 U.S.C. 154(b) by 0 days.

(21) Appl. No.: 12/658,675

(22) Filed: Feb. 12, 2010

(65) Prior Publication Data

US 2010/0146910 A1 Jun. 17, 2010

Related U.S. Application Data

(63) Continuation of application No. 12/378,496, filed on Feb. 17, 2009, now Pat. No. 7,721,366, which is a continuation-in-part of application No. 12/287,440, filed on Oct. 8, 2008, now Pat. No. 7,600,278.

(30) Foreign Application Priority Data

Oct. 19, 2007 (CN) ..... 2007 2 0008515 U

(51) Int. Cl.
*A47C 19/12* (2006.01)

(52) U.S. Cl. ..... 5/201; 5/200.1; 5/279.1; 5/282; 5/308

(58) Field of Classification Search ..... 5/201, 200.1, 5/202, 254, 174, 177, 279.1, 282, 308
See application file for complete search history.

(56) References Cited

U.S. PATENT DOCUMENTS

| | | | | |
|---|---|---|---|---|
| 710,477 | A | 10/1902 | Littell | |
| 3,546,725 | A | 12/1970 | Tambascio | 5/200 |
| 4,670,922 | A * | 6/1987 | Mis | 5/200.1 |
| 4,708,183 | A | 11/1987 | Figueroa | 150/52 |
| 5,060,712 | A | 10/1991 | Ehrlich | 160/330 |
| 6,076,212 | A | 6/2000 | Feld | 5/663 |
| 6,125,484 | A * | 10/2000 | Thomson | 5/200.1 |

OTHER PUBLICATIONS

Website of Glideaway Sleep Products, p. showing "Fasten up kit 6A" used to allow bolt on end plate to be converted to hook-up end plate, downloaded from www.glideaway.com/Products/ on Oct. 7, 2008. (3 pages).

* cited by examiner

*Primary Examiner* — Fredrick Conley
(74) *Attorney, Agent, or Firm* — Imperium Patent Works; Darien K. Wallace

(57) ABSTRACT

A folding mattress support system replaces both a conventional box spring and the bed frame with rails. The mattress support system is lighter, quieter and easier to transport, and also provides more storage space beneath the mattress. The mattress support system includes bed frame assemblies, central connecting bars, edge attachments and a bed skirt. Leg brackets fold out from the bed frame assemblies, which themselves unfold in the middle. Central connecting bars connect inner side edges of the bed frame assemblies. Plastic edge attachments are attached at outer corners of the bed frame assemblies and hold a bed skirt taught around the frame assemblies when the frame assemblies are standing on the extended leg brackets. A mattress is then placed on top of the assembled mattress support system. Optionally, metal edge attachments at the head corners of the mattress support system both hold the bed skirt and support a headboard.

20 Claims, 14 Drawing Sheets

MATTRESS SUPPORTING SYSTEM

CROSS REFERENCE TO RELATED APPLICATION

This application is a continuation of, and claims priority under 35 U.S.C. §120 from, nonprovisional U.S. patent application Ser. No. 12/378,496 entitled "Mattress Supporting System," filed on Feb. 17, 2009, now U.S. Pat. No. 7,721,366, the subject matter of which is incorporated herein by reference. Application Ser. No. 12/378,496, in turn, is a continuation-in-part of, and claims priority under 35 U.S.C. §120 from, nonprovisional U.S. patent application Ser. No. 12/287,440 entitled "Folding Bed Frame," filed on Oct. 8, 2008, now U.S. Pat. No. 7,600,278, the subject matter of which is incorporated herein by reference. Application Ser. No. 12/287,440, in turn, is a continuation-in-part of, and claims the benefit under 35 U.S.C. §119 from, Chinese Patent Application No. 200720008515.1, filed on Oct. 19, 2007, in China, the contents of which are incorporated herein by reference.

TECHNICAL FIELD

The described embodiments relate to bedding products, and more particularly to a folding bed frame and a mattress supporting system.

BACKGROUND INFORMATION

Conventional folding bed frames are relatively heavy and awkward. FIG. 1 (prior art) shows the structure of a conventional folding bed frame including a mattress frame 1 and support legs 2. Mattress frame 1 can be folded in half. The plurality of support legs 2 are pivotally connected under the mattress frame 1. In use, a mattress (not shown) is placed on the mattress frame 1. This structure of the folding bed frame must possess a certain level of bearing strength because the mattress frame 1 must support the mattress. In order to provide bearing strength, mattress frame 1 is made with relatively thick cross-bars and thinner vertical bars. The thick cross-bars have relatively large intervals between them, whereas the thinner vertical bars are spaced at relatively small intervals. The thick cross-bars and the thinner vertical bars are both welded to mattress frame 1. Although the bed frame of FIG. 1 provides stable support for a mattress, the bed frame is awkward and bulky. Because this type of bed frame is typically made of metal, the crossed design of the thick cross-bars and the vertical bars increases the weight of the bed frame even further. Especially in the case of a double bed that supports a queen or king size mattress, the bed frame is even more awkward and difficult to carry and transport.

In addition, the bed frame of FIG. 1 is not adaptable to different mattress sizes. Even a conventional bed frame that is sized for either a single bed or a double bed does not accommodate the various dimensions of the single and double mattresses, such as single, twin, full, double, queen, king and California king. A different bed frame size must be manufactured to accommodate each different mattress dimension. Because the bed frame of FIG. 1 cannot be standardized to fit multiple mattress dimensions, the manufacturing cost of the various sizes of the bed frame is increased.

A bed frame is sought that is lighter and less awkward than the conventional bed frame and that can accommodate multiple mattress dimensions. In addition, a folding bed frame is sought that can replace a conventional box spring.

SUMMARY

A folding bed frame includes standardized right and left bed frame assemblies. The bed frame assemblies are connected by a plurality of central connecting bars to form an adjustable bedboard frame that can accommodate mattresses of differing widths. The small, standardized bed frame assemblies can be manufactured at less cost than can a conventional unitary bed frame. In addition, the folding bed frame is easy to transport when disassembled into the separate frame assemblies that are each less than half the width of a conventional bed frame for a double bed. The bedboard frame formed by the standardized frame assemblies and the central connecting bars is lighter than the conventional unitary bed frame and is therefore less expensive to transport and easier to install.

Leg brackets are pivotally connected to the bottom of the bedboard frame under each bed frame assembly and support the bedboard frame and mattress. Each central connecting bar has U-shaped slots on its ends that clip over the inner side edges of the right and left bed frame assemblies. Each frame assembly has a hinge at its middle axis at which a lower half of the assembly folds over onto an upper half of the assembly to allow the frame assemblies to fit in a packing box. The leg brackets fold in to fit in the packing box.

Edge attachments are attached by screws to the upper left corner of the left bed frame assembly and to the upper right corner of right bed frame assembly. A headboard of the bed attaches to the edge attachments of the folding bed frame. Tongues on the headboard slip into slots in the edge attachments.

A method of packing the folding bed frame into a packing box involves folding lower halves of the bedboard frames of bed frame assemblies over onto upper halves of the bedboard frames. The leg brackets that are pivotally connected to the bedboard frames are folded in. The folded bedboard frames are then inserted into a packing box that is about half as long as the unfolded bedboard frames. The packing box has a width of little more than the width of one bed frame assembly. The packing box is about four times as thick as the folded-in leg brackets plus four times as thick as an unfolded bedboard frame. Central connecting bars are inserted into the packing box and fit between the folded-in leg brackets.

In one embodiment, the folding bed frame includes no central connecting bars. The folding bed frame includes right and left bed frame assemblies. The right bed frame assembly has a left inner side edge that faces the left bed frame assembly, and the left bed frame assembly has a right inner side edge that faces the right bed frame assembly. The left inner side edge is directly connected to the right inner side edge and forms a bedboard frame for a single bed.

An apparatus includes a packing box and a means for assembling a bed frame that fits mattresses of differing widths. The means is inserted into the packing box. The bed frame is adaptable to fit a mattress having an area that is larger than four times the length times the width of the packing box.

A folding bed frame at least comprises mutually connected left and right bed frame assemblies, one on each side. Each bed frame assembly includes a bedboard frame and a plurality of leg brackets that are pivotally connected under the bedboard frame. In one aspect, a bedboard frame for a single bed is provided in which no central connecting bars are used. In another aspect, a plurality of central connecting bars span between the left and right bed frame assemblies. Central connecting bars with different lengths are selected to accommodate mattresses of different widths. Thus, a bedboard frame for double beds with different widths can be conveniently manufactured without the need to re-manufacture the bed frame assemblies. The specifications of the bed frame assemblies are standardized, which greatly reduces the manufacturing cost of the folding bed frame.

In another embodiment, an apparatus includes a bed frame assembly and an edge attachment. The bed frame assembly has a hinge at which a first portion of the bed frame assembly is adapted to fold over onto a second portion of the bed frame assembly. A leg bracket is pivotally connected to the bed frame assembly. The edge attachment clips over a foot side edge and an outer side edge of the bed frame assembly and is adapted to hold a bed skirt taught around the bed frame assembly when the bed frame assembly is resting on the extended leg bracket.

The edge attachment holds the bed skirt such that more than half of the leg bracket is not visible behind the bed skirt when the bed frame assembly is resting on the extended leg bracket. The bed frame assembly also includes a second edge attachment that holds the bed skirt and that clips over the middle of the outer side edge of the bed frame assembly. A third edge attachment is attached to the head side edge and the outer side edge of the bed frame assembly and both holds the bed skirt taught around the bed frame assembly and holds a headboard.

The edge attachments at the corners of the bed frame assembly slant at an angle down and away from the bed frame assembly when no bed skirt is being held so that a bed skirt is held taught when the bed skirt is slipped on over the slanted edge attachments. A storage container with a floor height of at least twelve inches can slide past the bed skirt under the bed when the taught bed skirt is stretched.

A method for setting up a mattress support system includes the steps of: (i) removing a folded bed frame assembly and an edge attachment from a packing box, (ii) unfolding a first portion of the bed frame assembly from a second portion of the bed frame assembly that is pivotally connected to the first portion at a hinge, (iii) unfolding a leg bracket that is pivotally connected to the bed frame assembly, (iv) standing the unfolded bed frame on the unfolded leg bracket, (v) attaching the edge attachment at a corner or the bed frame assembly, (vi) slipping a bed skirt down over the edge attachment such that the bed skirt is held taught around the bed frame assembly when the bed frame assembly is standing on the unfolded leg bracket, and (vii) placing a mattress on top of the assembled bed frame assembly. The method also includes the steps of attaching a second edge attachment to the bed frame assembly at a second corner and attaching a headboard to the second edge attachment.

In yet another embodiment, an apparatus includes a bed frame assembly and a means for holding a bed skirt taught around the bed frame assembly when the bed frame assembly is standing on leg brackets. The means is also for holding a headboard of the bed frame assembly. The bed frame assembly has a hinge at which a first portion of the bed frame assembly folds over onto a second portion of the bed frame assembly. The bed frame assembly has leg brackets that are pivotally connected to the bed frame assembly.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

A less costly folding bed frame is disclosed that can accommodate mattresses of various dimensions. A standardized bed frame is provided that can be conveniently adjusted to various mattress widths. The folding bed frame includes a left bed frame assembly and a right bed frame assembly connected by a plurality of central connecting bars. The assembled bed frame forms a bedboard frame and a plurality of legs that are pivotally connected under the bedboard frame. The central connecting bars form part of the bedboard frame and connect the left bed frame assembly to the right bed frame assembly. Each end of each central connecting bar has a U-shaped slot opening downward. A U-shaped slot is clipped down over the inner side edge of a bed frame assembly. In one embodiment, the left and right bed frame assemblies are connected to each other via the central connecting bars through riveting or screwing.

The combined width of the pair of bed frame assemblies is narrower than the width of a traditional folding bed frame for a double bed. By connecting the left and right bed frame assemblies directly to each other through bolts, riveting or screwing without using the central connecting bars, a frame for a single bed is provided. A frame for a double bed is provided by spanning the plurality of central connecting bars between the left and right bed frame assemblies. Thus, the standardized left and right bed frame assemblies are adaptable to form frames for mattresses of various dimensions. In addition, the standardized left and right bed frame assemblies reduce the cost of manufacturing bed frames that accommodate different sized mattresses.

Because the central connecting bars are independent of the standardized left and right bed frame assemblies, the lengths of the bars can be easily varied. Bed frames that can accommodate different widths of mattresses can be manufactured simply by producing central connecting bars with different lengths. Central connecting bars having a specified length can be selected to match the width requirement of each bed without the need to re-manufacture a bedboard frame. Thus, the novel bed frame has a greatly reduced manufacturing cost.

Especially when configured as a frame for a double bed, the novel folding bed frame is much lighter than conventional folding bed frames with cross and vertical bars. The weight of the central connecting bars is less than that of the welded cross and vertical bars.

The novel folding bed frame is also easier to transport than a conventional folding bed frame. Conventional frames have a single mattress frame whose size hampers the ease of transport. The novel bed frame is divided into two bed frame assemblies connected by central connecting bars. The novel bed frame can be disassembled into the two separate bed frame assemblies that are easier to carry and transport.

Figure 1:
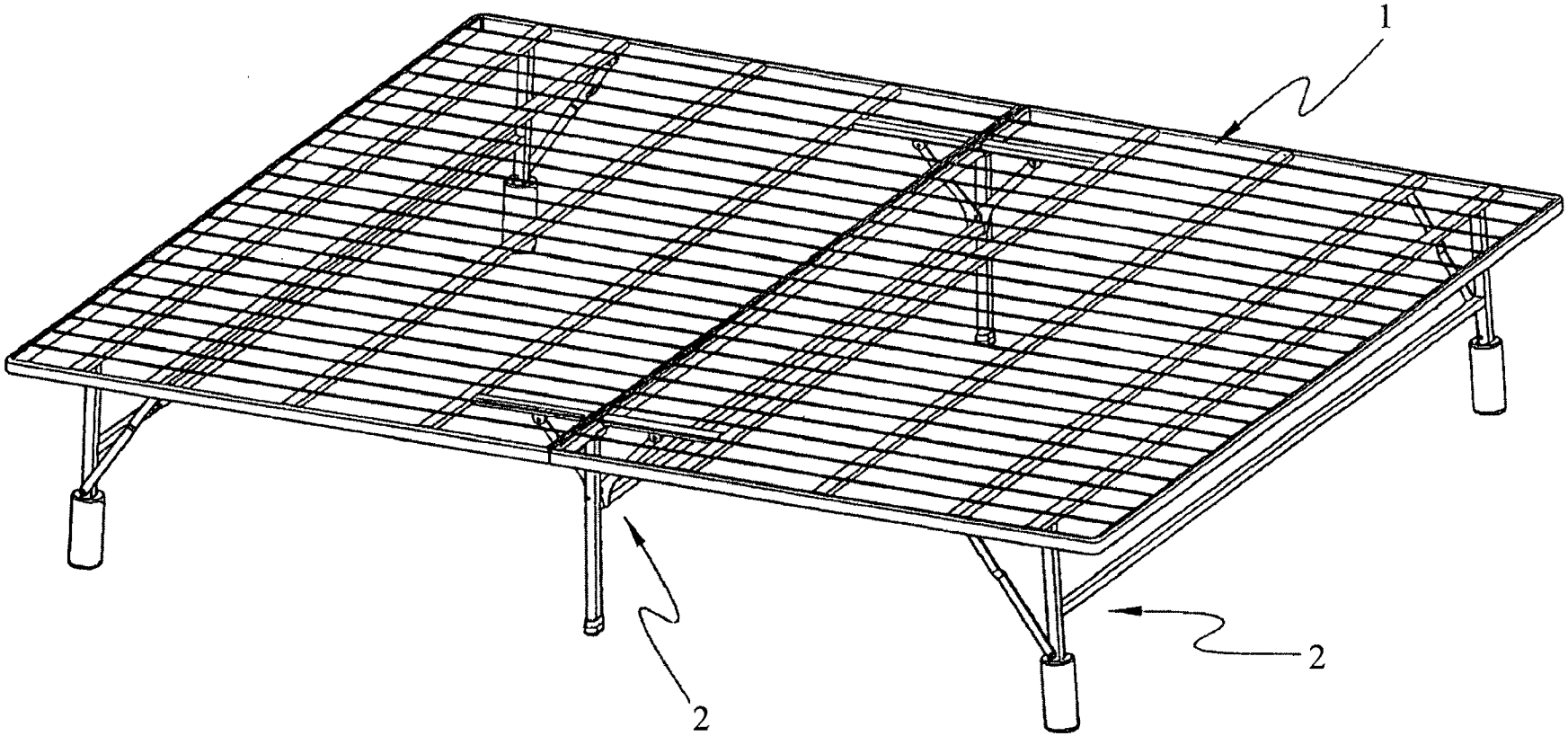
(PRIOR ART) FIG. 1
FIG. 1 (prior art) is a schematic view of a conventional folding bed frame.
Figure 2:
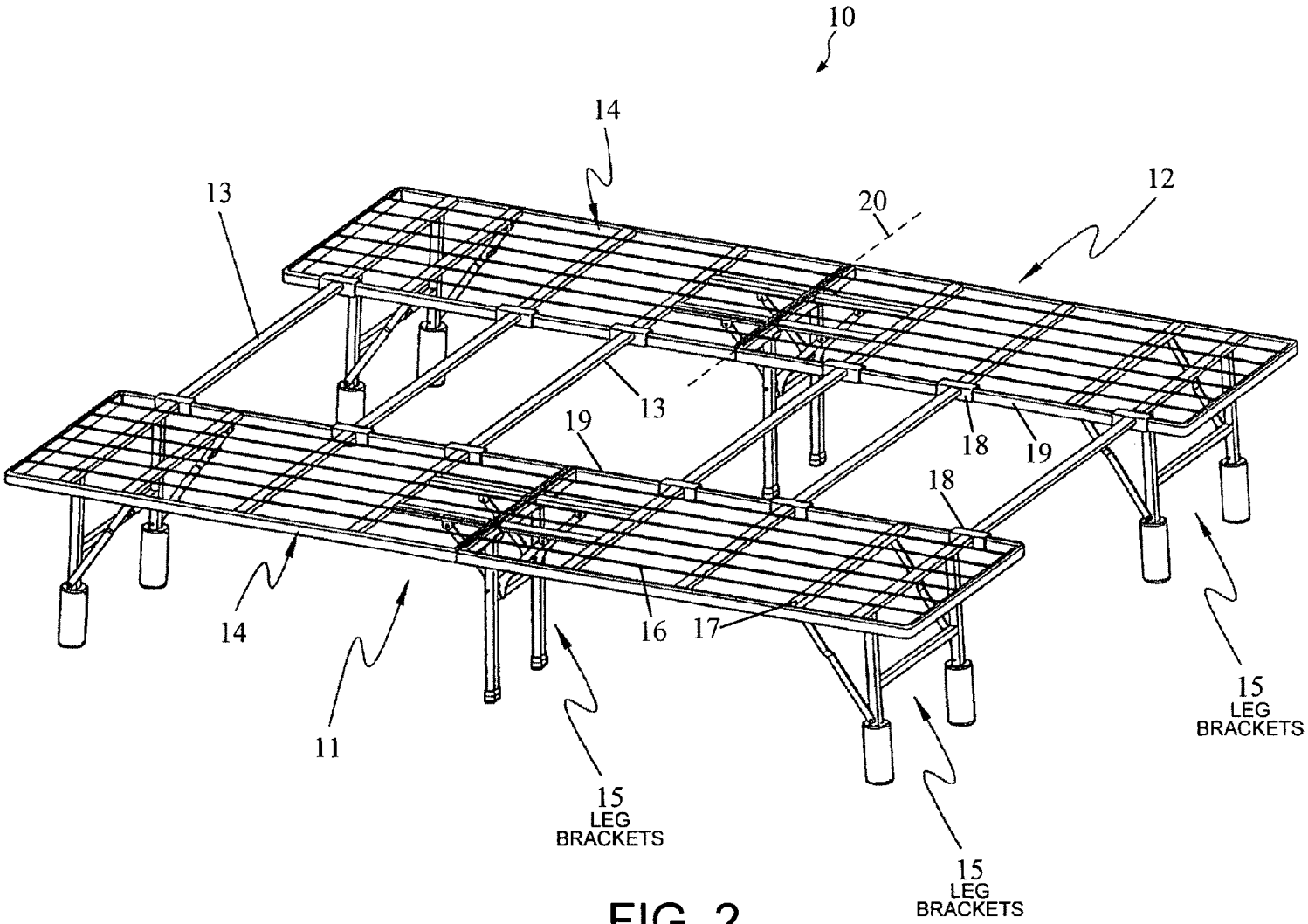
FIG. 2 is a schematic view of a novel folding bed frame that includes central connecting bars.

FIG. 2 shows a novel folding bed frame 10 that can accommodate mattresses of differing dimensions. Bed frame 10 includes a left bed frame assembly 11, a right bed frame assembly 12, and a plurality of central connecting bars 13. Each of frame assemblies 11 and 12 resembles a very narrow folding bed frame. Each of frame assemblies 11 and 12 includes a bedboard frame 14 and a plurality of leg brackets 15 pivotally connected under the bedboard frame 11. The bed frame assemblies 11 and 12 stand upon the leg brackets 15 when the leg brackets are folded out and locked. A bedboard frame is formed by longitudinal bars 16 welded to cross bars 17. In one embodiment, the longitudinal bars 16 are metal rods. Each leg bracket 15 includes two legs. Three exemplary leg brackets 15 are labeled in FIG. 2. Left bed frame assembly 11 differs from a conventional folding bed frame in that assembly 11 is narrower, normally less than half the width of a frame for a double bed.

Figure 3:
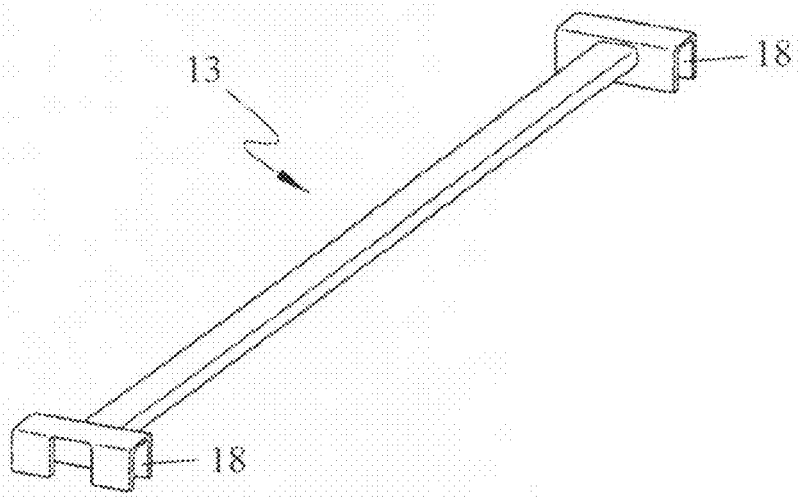
FIG. 3 is a more detailed view of one of the central connecting bars of the folding bed frame of FIG. 2.

FIG. 3 shows an exemplary central connecting bar 13 in more detail. Each central connecting bar is disposed between left bed frame assembly 11 and right bed frame assembly 12. Both ends of each central connecting bar 13 have a U-shaped slot 18 opening downward. The U-shaped slot 18 is clipped down over an inner side edge 19 of one of frame assemblies 11 or 12.

In another embodiment, the connection between the end of a central connecting bar 13 and an inner side edge 19 is made by inserting a narrow tip of the connecting bar through a hole in the side edge 19. Alternatively, the end of a central connecting bar 13 is bolted to the side edge 19. Other connection means can also be used to connect the central connecting bars to the inner side edges.

Folding bed frame 10 is shipped from the manufacturer to retail stores in a disassembled condition. Typically, a customer also purchases folding bed frame 10 in a disassembled condition and assembles the bed frame at home in the bedroom where the bed frame will be used. All of the disassembled pieces of folding bed frame 10 fit in a packing box having a length that is about half the length of each bed frame assembly. In the packing box, each bed frame assembly is folded at its middle axis 20, which is hinged. For example, the lower half of each bed frame assembly is folded over onto the upper half of the frame assembly in order to fit in the packing box. The packing box has a width of little more than the width of one bed frame assembly. The thickness of the box is about four times the thickness of the bedboard frame plus four times the thickness occupied by a folded leg bracket 15. The central connecting bars fit in the packing box between the folded-in leg brackets. Thus, the area defined by the length and width of the packing box is less than a quarter of the area of the mattress that fits on the bedboard frame formed by the bed frame assemblies and the central connecting bars.

To assemble bed frame 10, bed frame assemblies 11 and 12 are first deployed. The bedboard frame 14 of each bed frame assembly is unfolded, and the three leg brackets 15 of each frame assembly are folded out and locked. Right bed frame assembly 12 is placed to the right of left bed frame assembly 11. Next, the plurality of central connecting bars 13 are fixedly clipped onto the inner edges 19 of left and right bed frame assemblies 11 and 12 such that the bars transversely span between the left and right bed frame assemblies 11 and 12. The U-shaped slots 18 are clipped down over the metal bars that form the inner edges 19. Next, edge attachments 21 (not shown in FIG. 2) are attached by screws to the upper left corner of left bed frame assembly 11 and to the upper right corner of right bed frame assembly 12.

Figure 4:
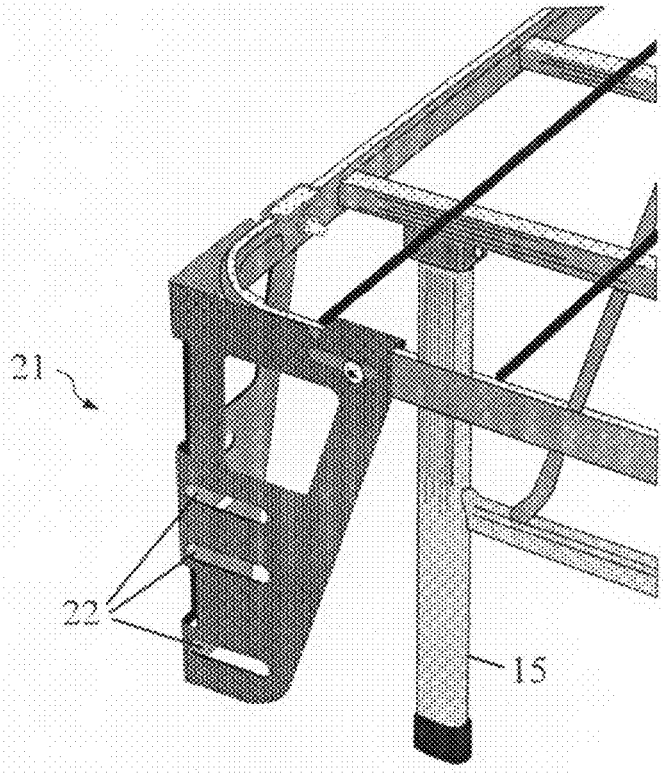
FIG. 4 is a schematic view of an edge attachment of the bed frame of FIG. 2 to which a headboard can be attached.

FIG. 4 shows the edge attachment 21 attached to the right head corner of right bed frame assembly 12. In this embodiment, edge attachment 21 clips over a head side edge as well as over an outer side edge of right bed frame assembly 12. Then edge attachment 21 is screwed in and hangs down from the side edge of right bed frame assembly 12. A headboard is attached to the edge attachments. Tongues on the headboard slip into slots 22 in edge attachment 21.

Figure 5:
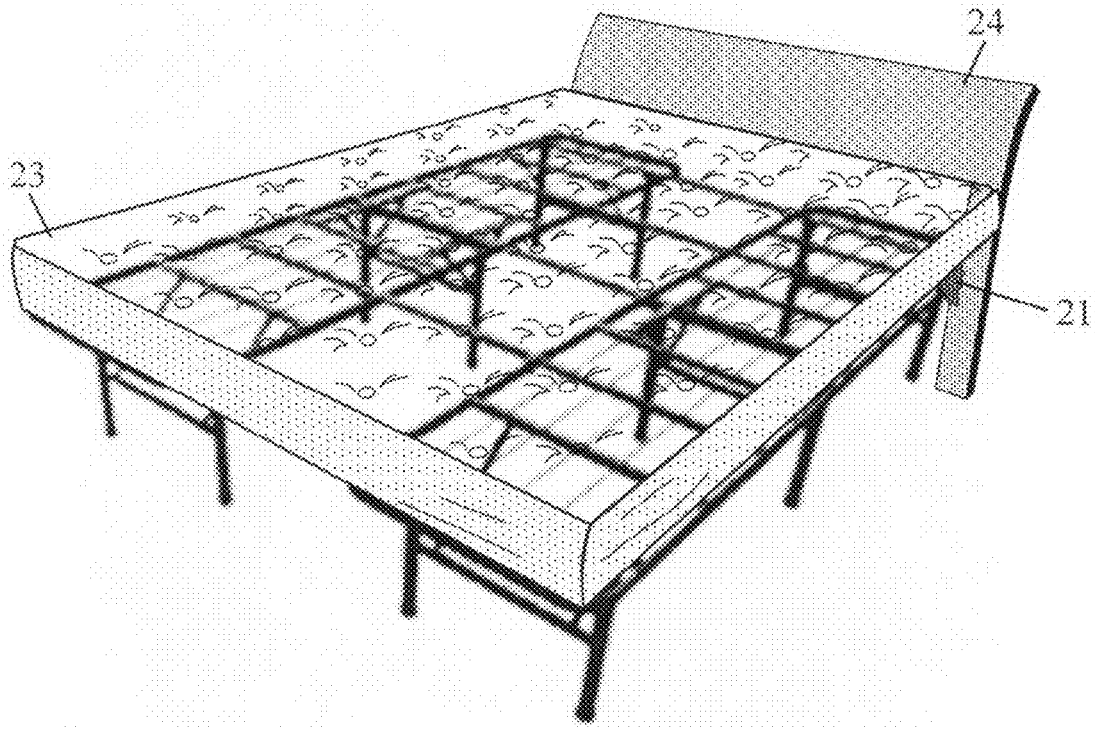
FIG. 5 is a perspective, cut-away view of a king size mattress placed on the folding bed frame of FIG. 2.

FIG. 5 shows a king size mattress 23 placed on 14 bedboard frame 14 of folding bed frame 10. A headboard 24 is attached to edge attachments 21. FIG. 5 illustrates that the area of bedboard frame 14 formed by the longitudinal bars 16 and cross bars 17 is limited to the sides where the bed frame assemblies are located. The central area of bedboard frame 14 is formed by the central connecting bars 13. Because the weight of the central connecting bars 13 is less than that of the longitudinal bars 16 and cross bars 17, folding bed frame 10 is lighter and less awkward. Folding bed frame 10 is also less awkward than conventional bed frames because the size of the disassembled, folded bed frame inside the packing box is smaller and can be more easily fit inside the trunk of a car or through a doorway.

Left and right bed frame assemblies 11 and 12 provide support on the side edges of mattresses of every width. Edge support is beneficial, as consumers tend to sit on the side of a mattress before getting in and out of bed. In one embodiment, some unsupported length remains at the foot of the mattress because the length of left and right bed frame assemblies 11 and 12 fits the length of a single mattress, and a headboard is attached to the head of the bed frame assemblies. In another embodiment, a central connecting bar connects the foot side edges of left and right bed frame assemblies 11 and 12 and provides support for mattress 23 at the foot of the bed.

In addition, the manufacturing cost of folding bed frame 10 is reduced because bed frame assemblies 11 and 12 are standardized, and the length of the central connecting bars 13 can be adjusted. In one embodiment, central connecting bars 13 having a length that is appropriate for the width of a certain mattress are included in the packing box. For example, shorter connecting bars are included in the packing box of a bed frame for a queen size mattress than are included in the box for a king size mattress. In another embodiment, the central connecting bars are conveniently adjustable by allowing one side of each connecting bar to telescope into the other side of the connecting bar. A screw from the outer bar then tightens into the inner bar to fix the length of the connecting bar. Alternatively, a connecting bar is made adjustable by sliding a smaller U-shaped bar inside a larger, outer U-shaped bar.

Figure 6:
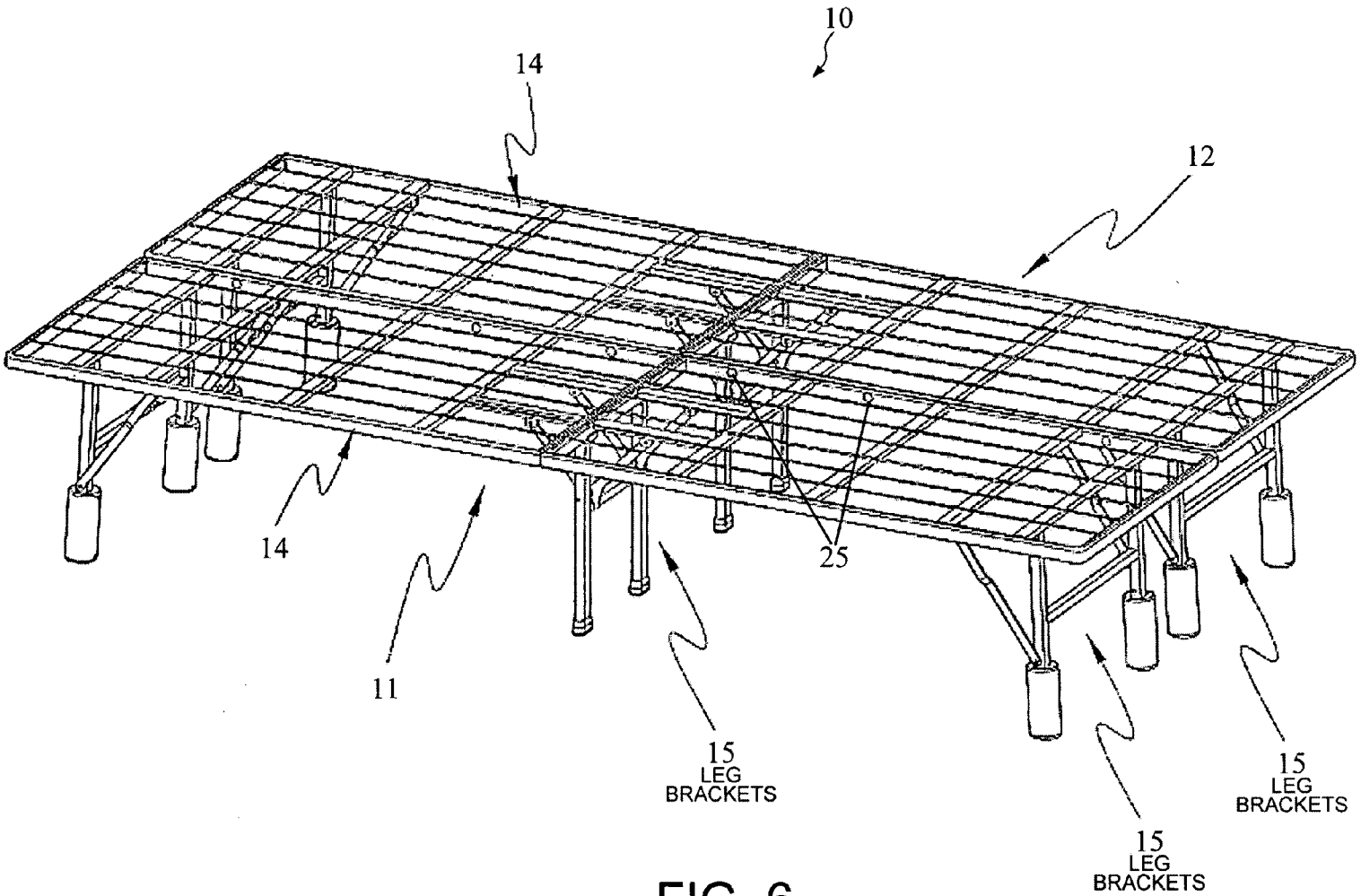
FIG. 6 is a schematic view of another embodiment of the folding bed frame of FIG. 2.

FIG. 6 shows another embodiment of folding bed frame 10 in which no central connecting bars are used. Left and right bed frame assemblies 11 and 12 are placed directly adjacent to each other. The inner side edges 19 of the bed frame assemblies 11 and 12 are attached to each other by bolts 25 and nuts. Alternatively, the bed frame assemblies 11 and 12 can be connected by screws or rivets. The bed frame of FIG. 6 has a width that is appropriate for a narrow mattress, such as an extra-long college twin mattress that measures 38 inches by 84 inches. Thus, the same standardized bed frame assemblies 11 and 12 form a bedboard frame 14 that supports mattresses of different dimensions. Not only is the manufacturing cost reduced, but the disassembled folding bed frame can be more conveniently packaged and transported.

Figure 7:
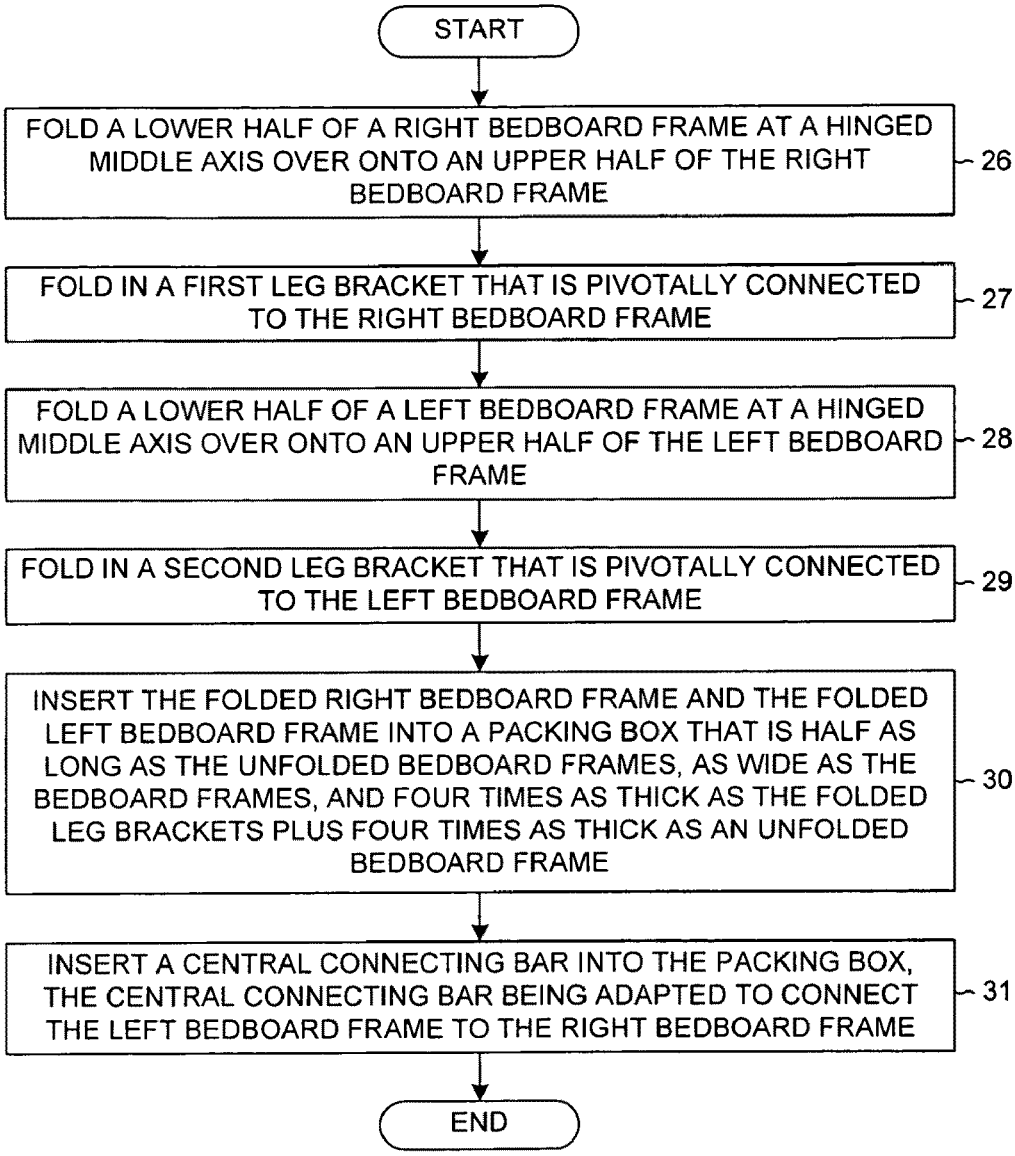
FIG. 7 is a flowchart illustrating steps of a method of packing the folding bed frame of FIG. 2 into a packing box.

FIG. 7 is a flowchart illustrating steps 26-31 of a method of packing folding bed frame 10 into a packing box that is conveniently sized for transporting. In a first step 26, a lower half of the bedboard frame 14 of right bed frame assembly 12 is folded over onto an upper half of the bedboard frame. Bedboard frame 14 is folded over at a hinge at middle axis 20.

In step 27, a first leg bracket 15 that is pivotally connected to the bedboard frame 14 of right bed frame assembly 12 is folded in. In step 28, a lower half of the bedboard frame 14 of left bed frame assembly 11 is folded over onto an upper half of the bedboard frame. In step 29, a second leg bracket 15 that is pivotally connected to the bedboard frame 14 of left bed frame assembly 11 is folded in. In step 30, the folded bedboard frame of right bed frame assembly 12 and the folded bedboard frame of left bed frame assembly 11 are inserted into a packing box. The packing box is about half as long as the unfolded bedboard frame of right bed frame assembly 12. The packing box has a width of little more than the width of right bed frame assembly 12. The packing box is about four times as thick as the folded first leg bracket plus four times as thick as the unfolded bedboard frame of right bed frame assembly 12. In step 31, a central connecting bar 13 is inserted into the packing box. The central connecting bar 13 is adapted to connect the bedboard frame of left bed frame assembly 11 to the bedboard frame of right bed frame assembly 12.

Figure 8:
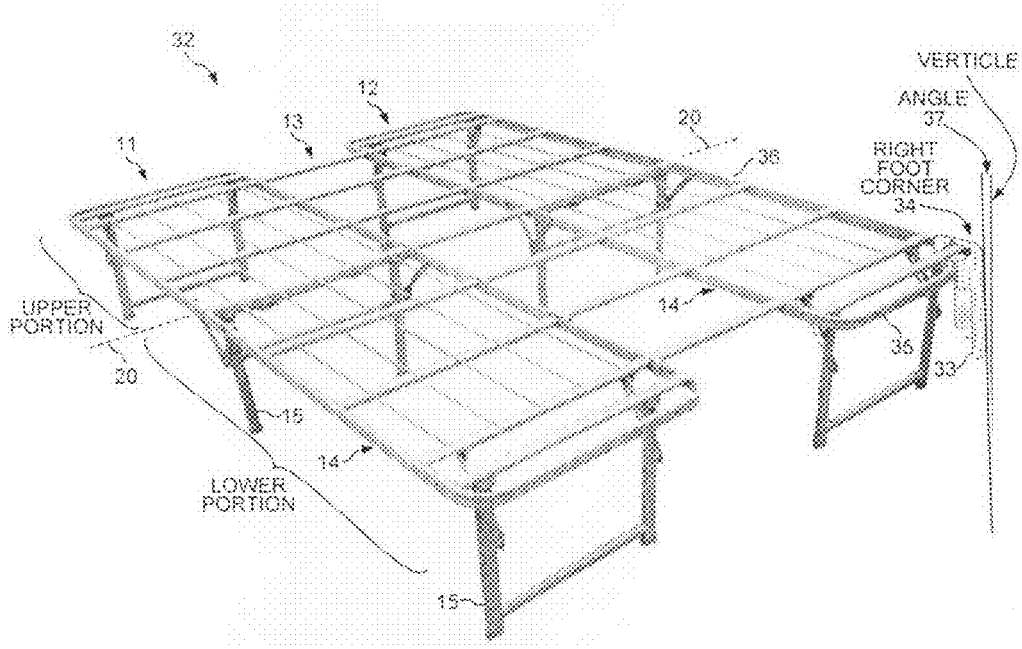
FIG. 8 is a perspective view of another embodiment of folding bed frames that form a mattress support system with edge attachments that hold a bed skirt taught.

FIG. 8 illustrates another embodiment of a folding bed frame that includes edge attachments for holding a bed skirt. The folding bed frame of FIG. 8 provides a mattress supporting system 32 that performs the functions of both a conventional box spring and a conventional metal bed frame with wood rails. Thus, mattress supporting system 32 can replace conventional bed frames and box springs. Mattress supporting system 32 includes left bed frame assembly 11, right bed frame assembly 12, and central connecting bars 13. Each of the bed frame assemblies 11 and 12 includes a bedboard frame 14. The bed frame assemblies 11 and 12 stand upon leg brackets 15 when the leg brackets are folded out and locked. Each bed frame assembly has a hinge at its middle axis 20 at which a lower portion of the assembly unfolds from an upper portion.

Mattress supporting system 32 includes an edge attachment 33 attached to the right foot corner 34 (the lower right corner) of right bed frame assembly. (For simplicity, the remaining edge attachments are not shown in FIG. 8, but are illustrated in subsequent figures.) Edge attachment 33 clips over a foot side edge 35 and an outer side edge 36 of right bed frame assembly 12. Edge attachment 33 is adapted to hold a bed skirt taught around both bed frame assemblies of mattress supporting system 32 when the bed frame assemblies are resting on the extended leg brackets 15.

In one embodiment of mattress supporting system 32, edge attachment 33 and the other edge attachments (not shown) slant at an angle 37 down and away from the bed frame assemblies when no bed skirt is being held such that a bed skirt that is slipped on over the slanted edge attachments is held taught. Edge attachment 33 slants down at an angle 37 that is about five to ten degrees from vertical. The bottom edge of the bed skirt is held taught as the bed skirt pulls the bottoms of the edge attachments inward. Thus, the long side of edge attachment 33 is oriented vertically when the bed skirt is slipped over mattress supporting system 32.

Figure 9:
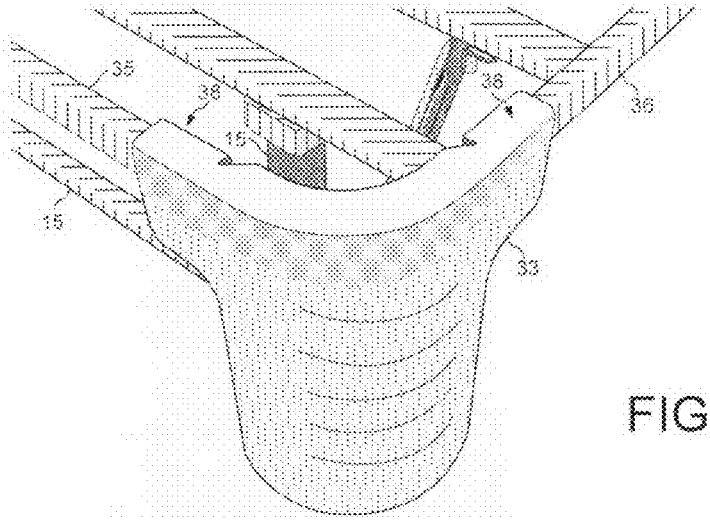
FIG. 9 shows an edge attachment of FIG. 8 in more detail.

FIG. 9 shows edge attachment 33 in more detail. In one embodiment, edge attachment 33 is made of hard molded plastic. Edge attachments at the foot of a bed are preferably made of plastic instead of metal to avoid injury to the shins, feet and children as consumers walk around the foot of mattress support system 32. Plastic edge attachments are also less expensive to manufacture than metal edge attachments. In addition, plastic edge attachments are lighter weight than metal edge attachments and are therefore less expensive to transport. Where stronger edge attachments are required to hold both a bed skirt and a headboard, metal is used. Clips 38 on edge attachment 33 clip down over foot side edge 35 and outer side edge 36 such that no screws, bolts or nuts are required to attach edge attachment 33 to the side edges.

Figure 10:
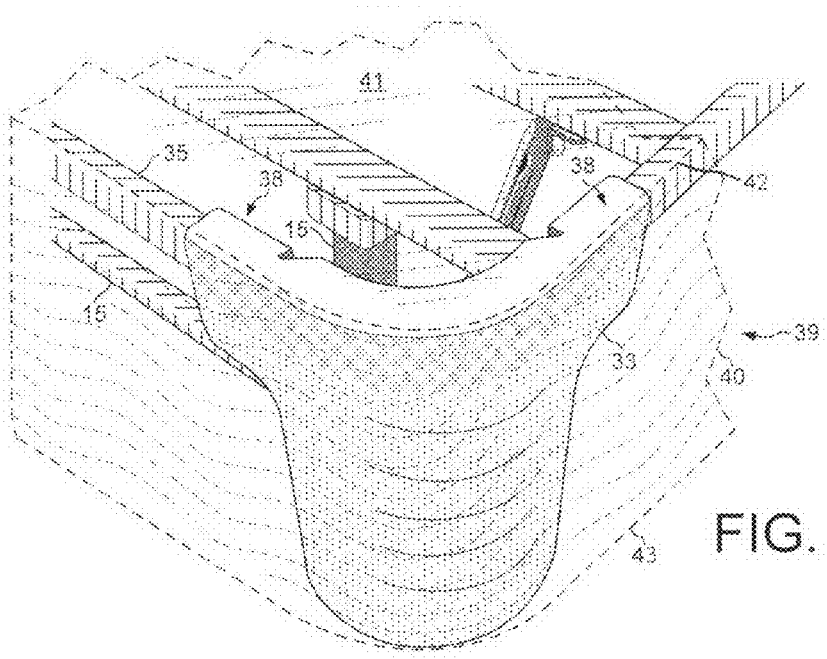
FIG. 10 is a cut-away view of a bed skirt that has been slipped on over the edge attachment of FIG. 9.

FIG. 10 is a cut-away view of a bed skirt 39 that has been slipped on over slanted edge attachment 33. Bed skirt 39 has a skirt portion 40 and center fabric 41. Skirt portion 40 has an upper edge 42 and a lower edge 43. While bed skirt 39 is slipped over the slanted edge attachments on the four corners of mattress support system 32, the edge attachments hold lower edge 43 of skirt portion 40 taught. Skirt portion 40 gives the appearance of a covering of a solid box spring. In one embodiment, center fabric 41 is made of a non-skid fabric such that a mattress placed on mattress support system 32 does not slip.

Figure 11:
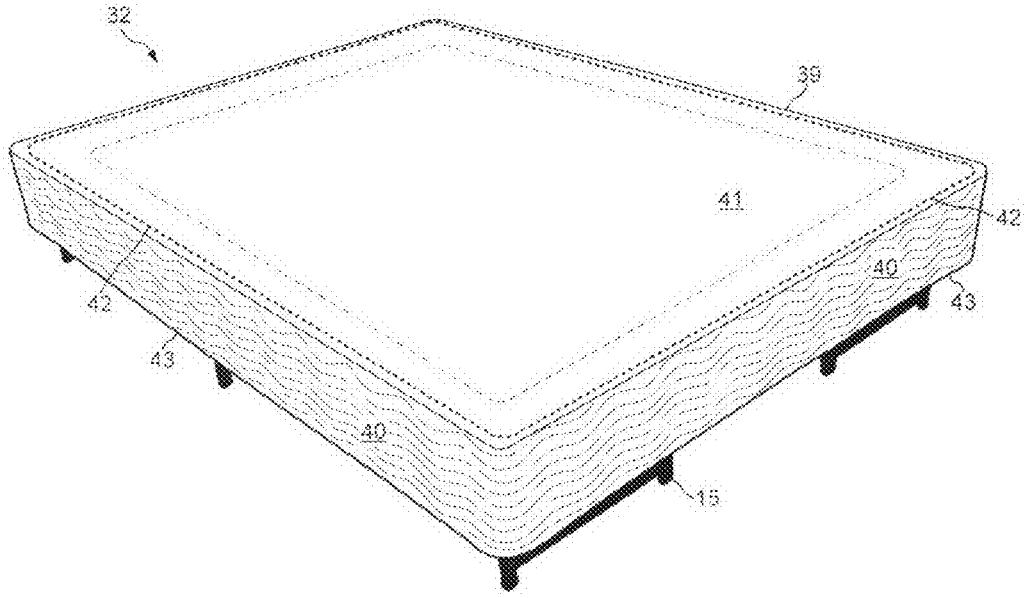
FIG. 11 is a perspective view of the mattress support system of FIG. 8 after a bed skirt has been slipped down over edge attachments and is held taught.

FIG. 11 shows bed skirt 39 after being slipped down over edge attachment 33 and the other edge attachments such that bed skirt 39 is held taught around bed frame assemblies 11 and 12 when the bed frame assemblies are standing on the unfolded leg brackets 15. The edge attachments hold bed skirt 39 such that more than half of each leg bracket 15 is not visible behind bed skirt 39 when the bed frame assemblies are resting on the extended leg brackets 15. Thus, mattress support system 32 appears to be a solid box spring sitting on short legs.

Although mattress support system 32 has an appearance similar to a conventional box spring, mattress support system 32 has several advantages over a conventional box spring that is supported by the metal rails of a conventional bed frame. First, mattress support system 32 is easier to move than a conventional box spring. Whereas a conventional box spring is constructed with a unitary wood frame that cannot be bent or disassembled into pieces, mattress support system 32 can be delivered in a relatively small packing box. Consequently, mattress support system 32 can be transported in an elevator and moved around the bend in a staircase, whereas a queen or king size box spring may be too large or awkward. Mattress support system 32 fits in a packing box that is about half as long as the unfolded bed frame assemblies and about as wide as the width of one bed frame assembly.

Second, mattress support system 32 is lighter than a conventional bed frame and box spring, and thus is both less expensive and easier to transport. The wood frame of a conventional box spring has solid sides, which weigh more than the edge attachments of mattress support system 32 over which the fabric of the bed skirt is stretched. Wood beams of a conventional box spring form both a top surface and a bottom surface, whereas the bottom of mattress support system 32 remains open. The leg brackets of mattress support system 32 are lighter than a conventional metal bed frame with wooden rails upon which the conventional box spring sits.

Third, mattress support system 32 is quieter than a conventional box spring sitting on wooden rails of a bed frame. As a person moves on a mattress, the joints in the wood of the box spring squeak. In addition, movement of the box spring over the wooden rails also makes noise. The metal construction of mattress support system 32 is less likely to make noise as a person moves on a mattress supported by the support system.

Fourth, mattress support system 32 provides a significant amount of storage space beneath the supported mattress. Because the wood frame of a conventional box spring has solid sides and beams forming top and bottom surfaces, the volume inside a conventional box spring cannot be accessed for storage. On the other hand, mattress support system 32 is open at the bottom and permits that space between the leg brackets 15 to be used for storage.

Figure 12:
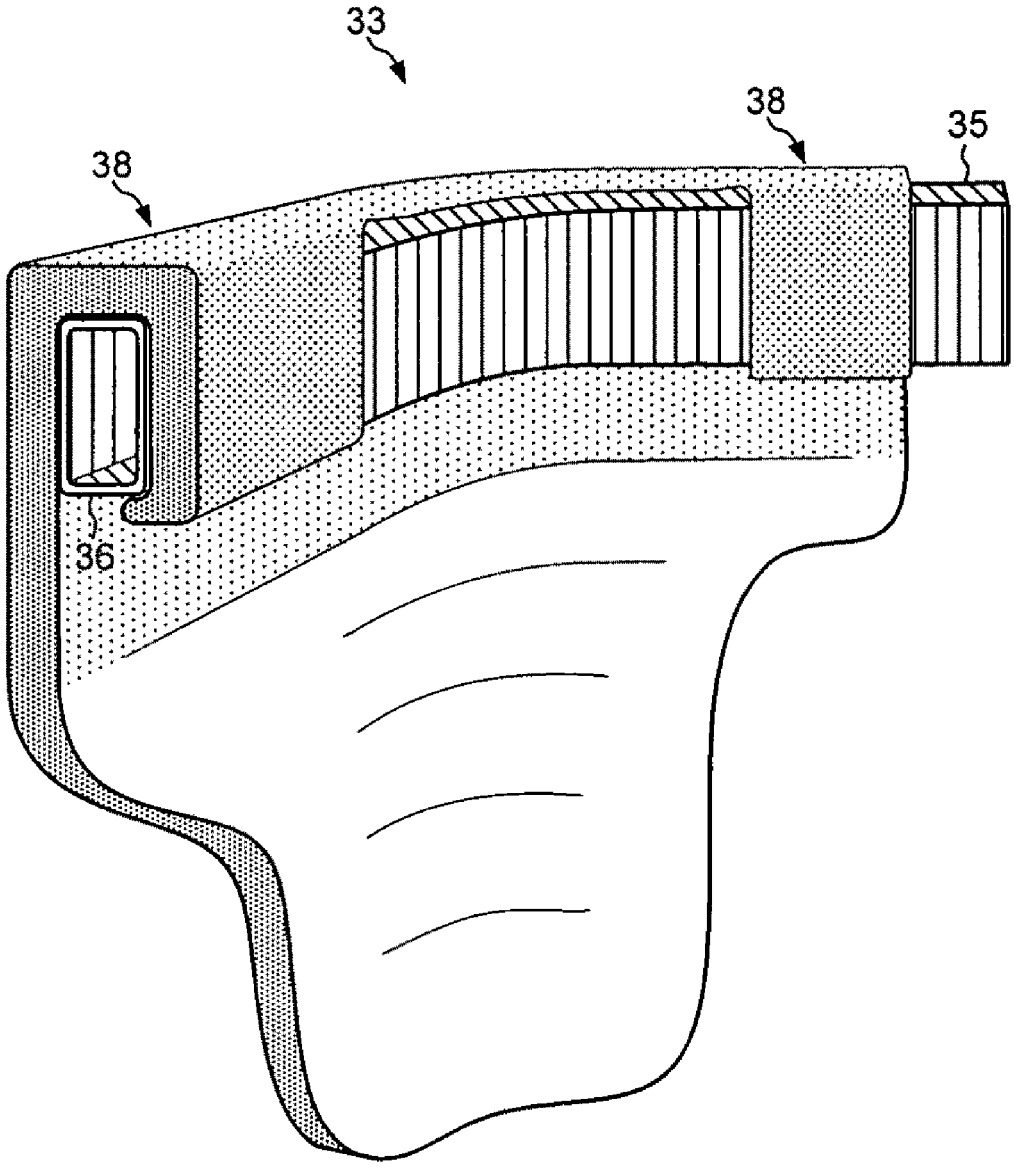
FIG. 12 is a rear view of the edge attachment of FIG. 9.

FIG. 12 is a rear view of edge attachment 33 of FIG. 9. In the view of FIG. 12, foot side edge 35 and outer side edge 36 have been cut away. FIG. 12 illustrates how a clip 38 clips down over and locks to outer side edge 36. Clip 38 holds edge attachment 33 firmly to the side edges without using separate attachment pieces, such as screws, bolts or nuts.

Figure 13:
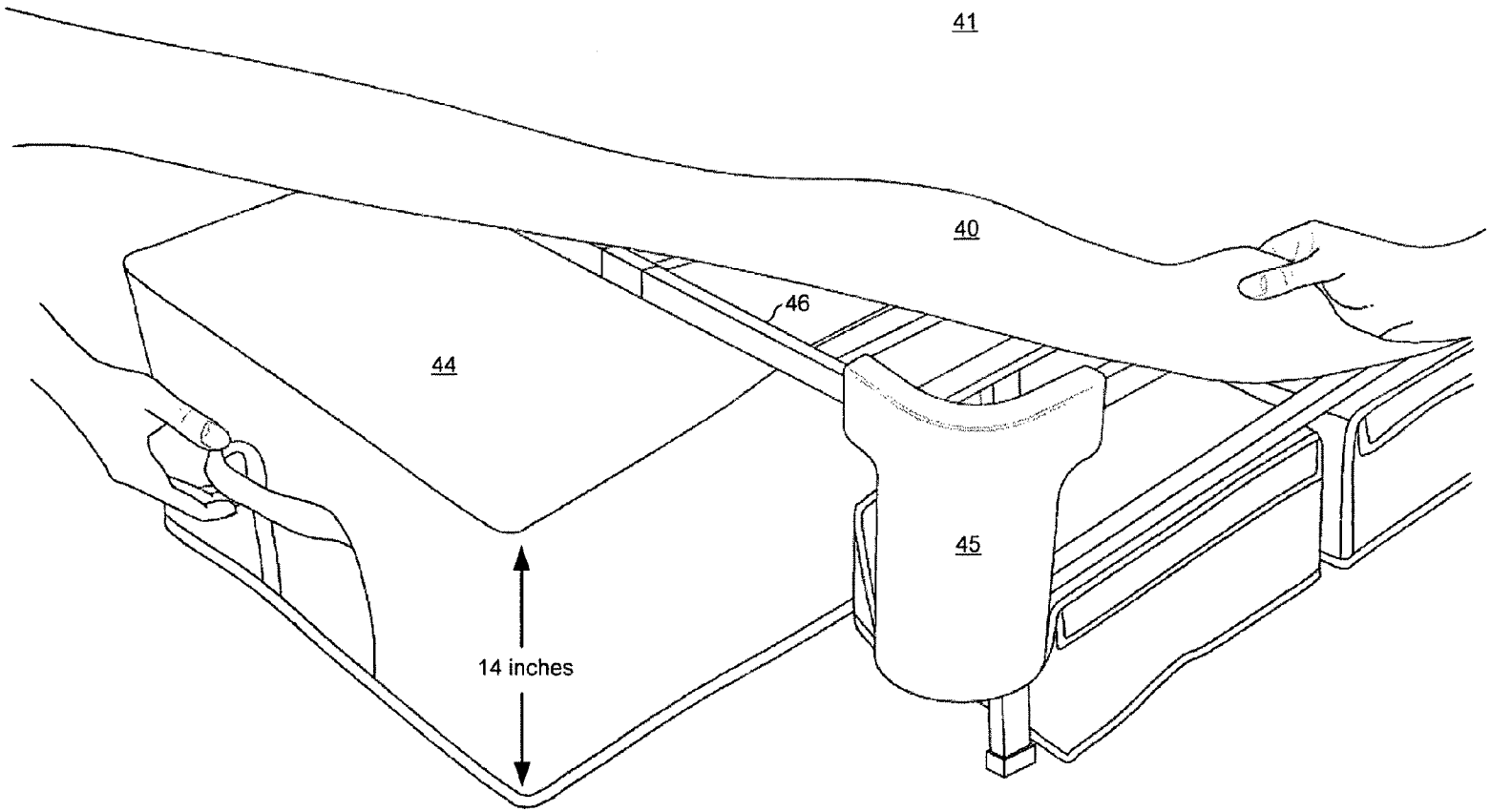
FIG. 13 illustrates a large storage container being slid past the bed skirt and inserted under the mattress support system of FIG. 8.

FIG. 13 illustrates the significant storage area available beneath a mattress supported by mattress support system 32. A large storage container 44 can be slid past bed skirt 39 and inserted under mattress support system 32. Storage container 44 has a floor height of more than twelve inches and would not fit under the rail of a conventional bed frame that stands only a few inches off the floor. A bed frame assembly and an edge attachment 45 are adapted to allow storage container 44 to slide under the bed frame assembly when the taught bed skirt 39 is stretched at the middle of a side between edge attachments. In FIG. 13, skirt portion 40 of bed skirt 39 has been detached from left foot edge attachment 45 to allow storage container 44 to be slid under mattress support system 32 past the skirt portion 40. In the embodiment of FIG. 13, storage container 44 has a floor height of fourteen inches and slides below outer side edge 46.

Figure 14:
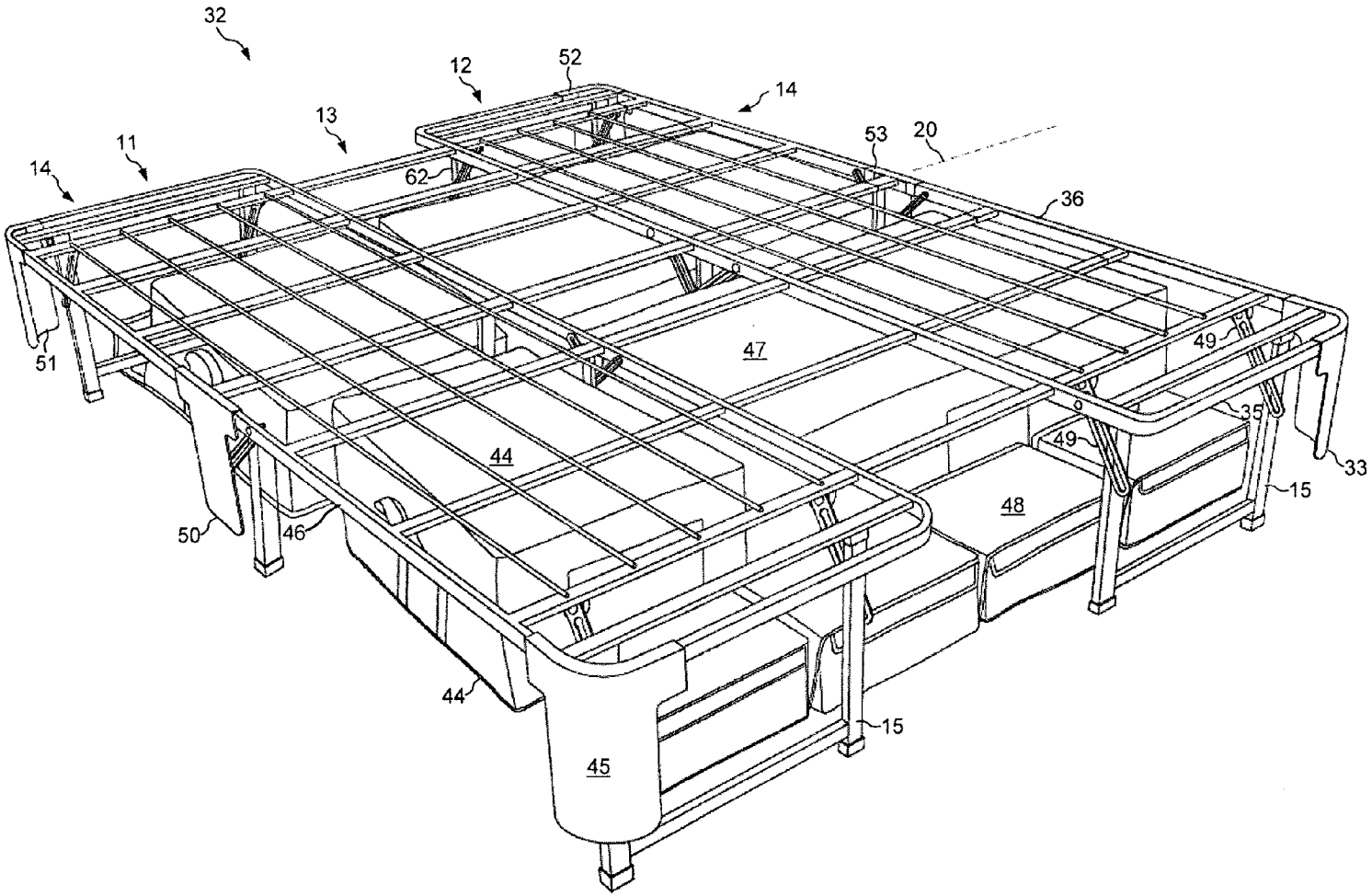
FIG. 14 is a perspective view illustrating how storage containers fit underneath the mattress support system of FIG. 8.

FIG. 14 is a picture of mattress support system 32 illustrating how twelve storage containers fit underneath bed frame assemblies 11 and 12 and central connecting bars 13. For purposes of illustration, mattress support system 32 is shown in FIG. 14 without bed skirt 39. In addition to large storage container 44, which fits under left bed frame assembly 11, there is an even bigger storage container 47 that fits under right bed frame assembly 12 and central connecting bars 13. A smaller storage container 48 slides under the side edges and under the diagonal support bars 49 near the foot of the mattress support system 32.

In the embodiment of FIG. 14, mattress support system 32 has six edge attachments: four at the corners and two at the middle of the sides. In addition to left foot edge attachment 45 and edge attachment 33 at the bottom right corner of mattress support system 32, FIG. 14 also shows a side edge attachment 50. Side edge attachment 50 stabilizes skirt portion 40 of bed skirt 39 at the middle of outer side edge 46 while skirt portion 40 is being held taught by left foot edge attachment 45 and a left head edge attachment 51. In one embodiment, the bottom of side edge attachment 50 holds lower edge 43 of skirt portion 40 down such that lower edge 43 forms a straight line from the bottom of left foot edge attachment 45 to the bottom of left head edge attachment 51.

Figure 15:
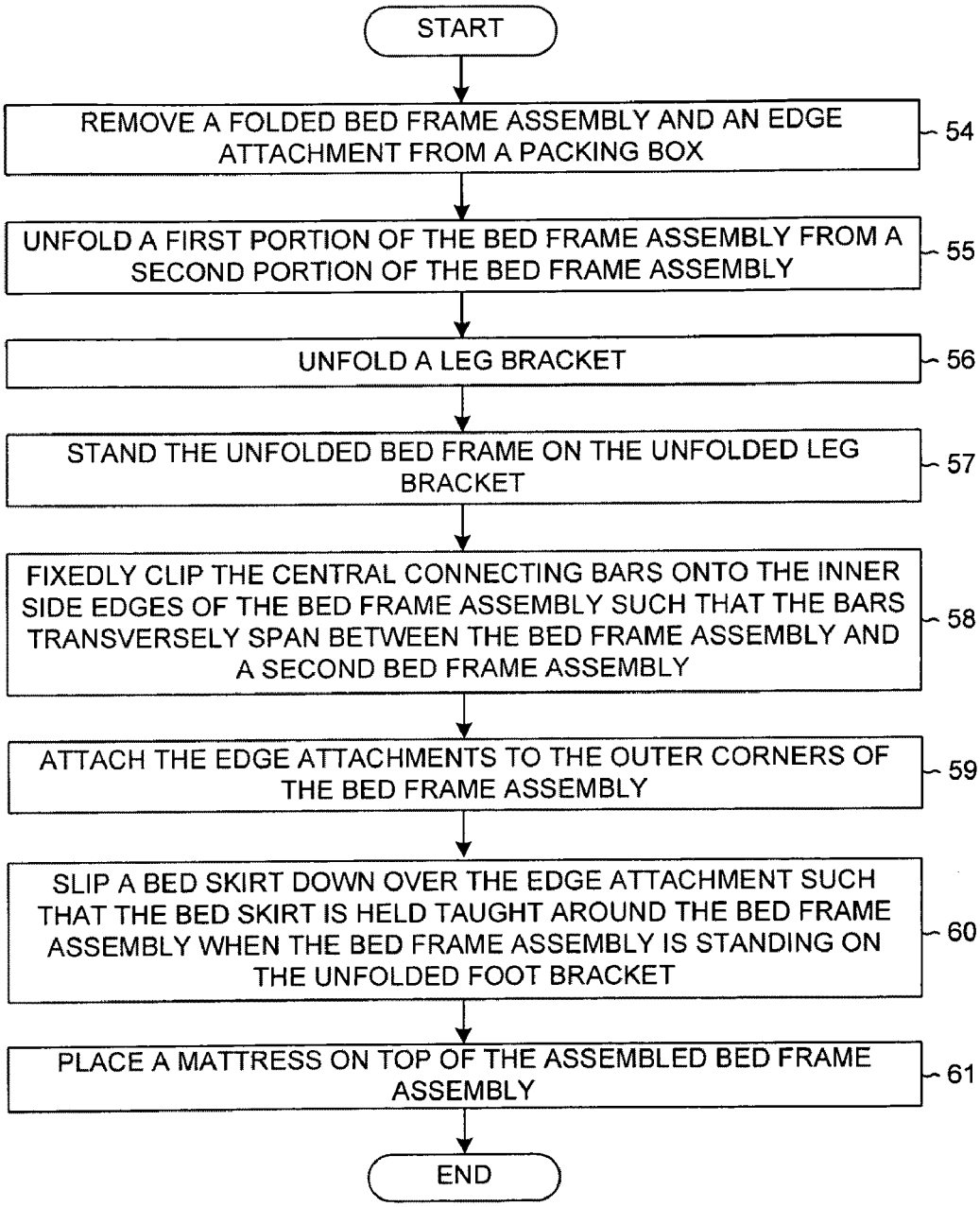
FIG. 15 is a flowchart illustrating steps of a method of assembling the mattress support system of FIG. 8.

FIG. 15 is a flowchart illustrating steps 54-61 of a method of setting up mattress support system 32. In a first step 54, the contents are removed from a packing box containing mattress support system 32. In the embodiment of FIG. 8, the packing box includes left bed frame assembly 11, right bed frame assembly 12, seven central connecting bars 13, six edge attachments 33, 45, 50-53 and bed skirt 39. Leg brackets 15 are part of bed frame assemblies 11 and 12. Thus, right bed frame assembly 12 and edge attachment 33 are removed from the packing box.

In a step 55, the upper portion of each bed frame assembly is unfolded from the lower portion at hinges located along middle axis 20. In the folded condition in the packing box, the leg brackets are folded into the outer sides of each folded bed frame assembly. In step 55, the upper portion of right bed frame assembly 12 is unfolded from the lower portion of bed frame assembly 12.

In a step 56, the leg brackets 15 are unfolded. For example, a leg bracket 62 that is pivotally connected to the upper portion of right bed frame assembly 12 is unfolded and locked into place.

In a step 57, the unfolded bed frame assemblies 11 and 12 are stood on the unfolded leg brackets 15. For example, the unfolded right bed frame assembly 12 is stood on unfolded leg brackets 15, including unfolded and locked leg bracket 62.

In a step 58, central connecting bars 13 are fixedly clipped onto the inner side edges of bed frame assemblies 11 and 12 such that the bars transversely span between the bed frame assemblies.

In a step 59, the edge attachments are attached to the outer corners and to the middle of the outer sides of bed frame assemblies 11 and 12. For example, edge attachment 33 is clipped down over the side edges at the right foot corner of mattress support system 32. Edge attachment 50 is clipped down over outer side edge 46 halfway between left foot edge attachment 45 and left head edge attachment 51.

In a step 60, a bed skirt is slipped down over bed frame assemblies 11 and 12 and over the edge attachments. The four edge attachments 33, 45, 51, 52 at the corners of mattress support system 32 hold the bed skirt taught around the bed frame assemblies when the bed frame assemblies are standing on the unfolded leg brackets. For example, bed skirt 39 is slipped down over edge attachment 33 such that skirt portion 40 of bed skirt 39 is held taught around right bed frame assembly 12. When skirt portion 40 is pulled down over the edge attachments, center fabric 41 is also pulled taught over the bedboard frames of bed frame assemblies 11 and 12.

In a step 61, a mattress 63 is placed on center fabric 41 over the assembled mattress support system 32.

Figure 16:
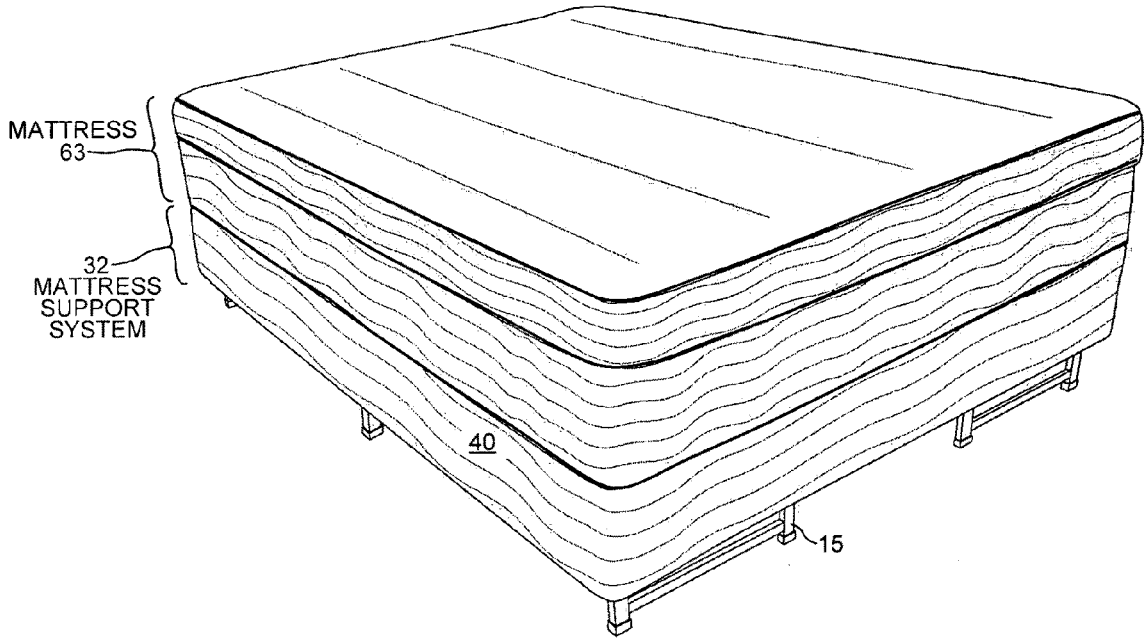
FIG. 16 is a perspective view of a mattress on top of the assembled mattress support system of FIG. 8 after the method of FIG. 15 has been performed.

FIG. 16 shows the assembled mattress support system 32 after the method of FIG. 15 has been performed. Mattress support system 32 has been set up with mattress 63 resting on top of center fabric 41.

In another embodiment, another type of edge attachment is attached to the left head corner and to the right head corner of mattress support system 32. In this embodiment, the edge attachments on the head corners of mattress support system 32 are made of metal and resemble edge attachment 21 of FIG. 4. The metal edge attachments either screw into or are clipped down over the side edges. Then bed skirt 39 is slipped down over the two plastic edge attachments at the foot corners and over the two metal edge attachments at the head corners of mattress support system 32. Slits are made in the head side of skirt portion 40 to allow tongues on a headboard to slip into slots in the metal edge attachments. Thus, the metal edge attachments are used both to hold skirt portion 40 taught around mattress support system 32, as well as to hold a headboard. As shown in FIG. 4, the metal edge attachment is adapted to hold a headboard that attaches to the edge attachment only at locations below the head side edge of the bed frame assembly.

Figure 17:
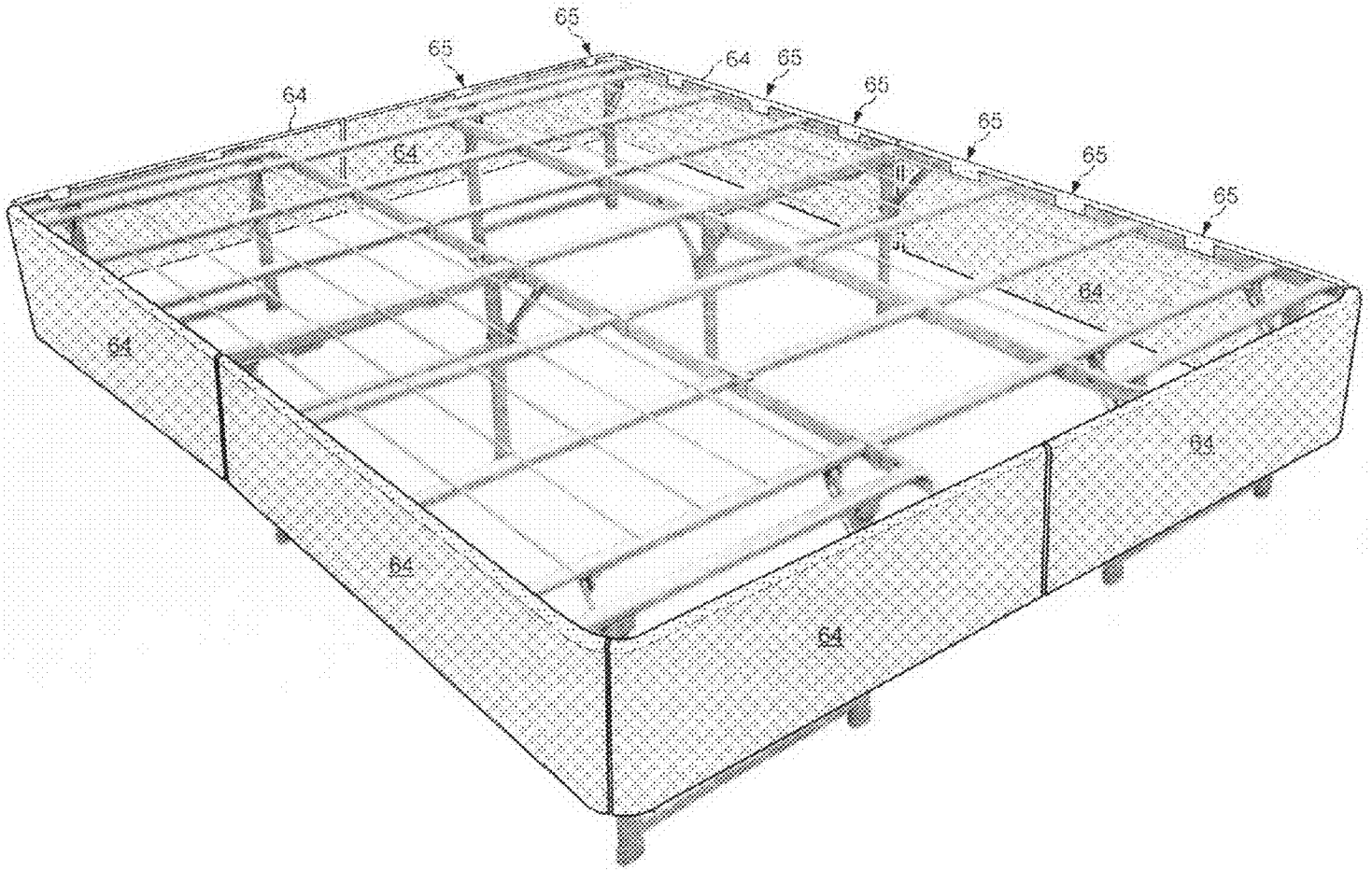
FIG. 17 is a perspective view of another embodiment in which solid plastic edge attachments cover the sides of the mattress support system in place of the bed skirt.

FIG. 17 shows yet another embodiment in which the edge attachments cover the sides of mattress support system 32 in place of bed skirt 39. The embodiment of FIG. 17 has solid plastic edge attachments 64 that snap down with clips 65 over the side edges. Edge attachments 64 do not attach to the side edges at the corners, as do edge attachments 33, 45, 51, 52, but rather attach along a large section of each side edge and meet at the corners. In the embodiment of FIG. 17, there are two edge attachments per side edge. The hard plastic of edge attachments 64 may be made in different colors so as to provide beds in a variety of colors. When the sides of mattress support system 32 are covered by edge attachments 33, 45, 51, 52, mattress support system 32 has the appearance of a platform bed.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A method comprising:

folding in a first foot bracket on a right bedboard frame, wherein the first foot bracket is pivotally connected to the right bedboard frame;

folding a first portion of the right bedboard frame under a second portion of the right bedboard frame;

folding in a second foot bracket on a left bedboard frame, wherein the second foot bracket is pivotally connected to the left bedboard frame;

folding a first portion of the left bedboard frame under a second portion of the left bedboard frame;

inserting the folded right bedboard frame and the folded left bedboard frame into a packing box; and inserting a central connecting bar into the packing box, wherein the central connecting bar is adapted to connect the left bedboard frame to the right bedboard frame.

2. The method of claim 1, wherein the right bedboard frame has an inner side edge, wherein the central connecting bar has a U-shaped slot on one end, and wherein the U-shaped slot is adapted to clip over the inner side edge.

3. The method of claim 1, wherein the central connecting bar has a first side and a second side, and wherein the central connecting bar has a length that is adjustable by allowing the first side to telescope into the second side.

4. The method of claim 1, further comprising:

inserting an edge attachment of the right bedboard frame into the packing box, wherein the edge attachment is adapted to clip over both an upper side edge and an outer side edge of the right bedboard frame and to hold a headboard of a bed.

5. The method of claim 1, further comprising:

inserting an edge attachment of the right bedboard frame into the packing box, wherein the right bedboard frame has an upper side edge and an outer side edge that meet at a corner, and wherein the edge attachment is adapted to hold a bed skirt taut around the right bedboard frame and the left bedboard frame.

6. The method of claim 1, wherein the right bedboard frame has a hinge at its middle axis at which the first portion of the right bedboard frame is folded under the second portion of the right bedboard frame.

7. The method of claim 1, wherein the packing box is about half as long as the unfolded right bedboard frame, wherein the right bedboard frame has a frame width, wherein the packing box has a box width of little more than the frame width, and wherein the packing box is about four times as thick as the folded first foot bracket plus four times as thick as the unfolded right bedboard frame.

8. A method comprising:

removing a folded bed frame assembly and an edge attachment from a packing box;

unfolding a first portion of the bed frame assembly from a second portion of the bed frame assembly, wherein the first portion and the second portion are pivotally connected at a hinge, wherein the unfolded bed frame assembly has an outer side edge and a foot side edge that meet at a corner, and wherein a leg bracket is pivotally connected to the first portion;

unfolding the leg bracket;

standing the unfolded bed frame on the unfolded leg bracket;

attaching the edge attachment at the corner; and slipping a bed skirt down over the edge attachment such that the bed skirt is held taut around the bed frame assembly when the bed frame assembly is standing on the unfolded leg bracket.

9. The method of claim 8, wherein the unfolded bed frame assembly has an upper side edge that meets the outer side edge at a second corner, further comprising:

attaching a second edge attachment to the bed frame assembly at the second corner; and attaching a headboard to the second edge attachment.

10. The method of claim 8, further comprising:

placing a mattress on top of the bed frame assembly.

11. The method of claim 8, further comprising:

transporting the packing box including the folded bed frame assembly in an elevator.

12. The method of claim 8, wherein the bed skirt has a skirt portion and center fabric, and wherein the center fabric is made of a non-skid fabric such that a mattress placed on the bed frame assembly does not slip.

13. The method of claim 8, wherein the attaching the edge attachment involves clipping the edge attachment down over the outer side edge and down over the foot side edge at the corner.

14. The method of claim 8, wherein the attaching the edge attachment is performed without using any screws, bolts or nuts.

15. A method comprising:

removing a right folded bed frame assembly, a left folded bed frame assembly and a central connecting bar from a packing box;

unfolding a first portion of the right bed frame assembly from a second portion of the right bed frame assembly, wherein a leg bracket is pivotally connected to the first portion, wherein the unfolded right bed frame assembly has a width sufficient to support substantially all of a mattress' width, and wherein the unfolded right bed frame assembly has a left side edge that faces an unfolded left bed frame assembly;

unfolding the leg bracket;

standing the unfolded right bed frame assembly on the unfolded leg bracket; and attaching the central connecting bar to the left side edge.

16. The method of claim 15, wherein the unfolded left bed frame assembly has a right side edge, further comprising:

attaching the central connecting bar to the right side edge.

17. The method of claim 15, further comprising:

unfolding a third portion of the right bed frame assembly from the second portion of the right bed frame assembly, wherein a second leg bracket is pivotally connected to the third portion.

18. A method comprising:

removing a right folded bed frame assembly, a left folded bed frame assembly and a central connecting bar from a packing box;

unfolding a first portion of the right bed frame assembly from a second portion of the right bed frame assembly, wherein a leg bracket is pivotally connected to the first portion, and wherein the unfolded right bed frame assembly has a left side edge that faces an unfolded left bed frame assembly;

unfolding the leg bracket;

standing the unfolded right bed frame assembly on the unfolded leg bracket; and attaching the central connecting bar to the left side edge, wherein the central connecting bar has a U-shaped slot on one end, and wherein the attaching the central connecting bar to the left side edge involves clipping the U-shaped slot over the left side edge.

19. The method of claim 18, wherein the unfolded right bed frame assembly has a right side edge and a foot side edge that meet at a corner, further comprising:

removing an edge attachment from the packing box;

attaching the edge attachment at the corner; and slipping a bed skirt down over the edge attachment such that the bed skirt is held taut around the unfolded right bed frame assembly and unfolded left bed frame assembly.

20. The method of claim 18, wherein the unfolded right bed frame assembly has a right side edge and a head side edge that meet at a corner, further comprising:

removing an edge attachment from the packing box;

attaching the edge attachment at the corner; and attaching a headboard to the edge attachment.

* * * * *